US008222988B2

(12) United States Patent
Braun et al.

(10) Patent No.: US 8,222,988 B2
(45) Date of Patent: Jul. 17, 2012

(54) POROUS DEVICE FOR OPTICAL AND ELECTRONIC APPLICATIONS AND METHOD OF FABRICATING THE POROUS DEVICE

(75) Inventors: Paul V. Braun, Savoy, IL (US); James J. Coleman, Monticello, IL (US); Victor C. Elarde, Evanston, IL (US); Erik C. Nelson, Urbana, IL (US); Varun B. Verma, Woodstock, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 433 days.

(21) Appl. No.: 12/462,297

(22) Filed: Jul. 30, 2009

(65) Prior Publication Data

US 2010/0065889 A1 Mar. 18, 2010

Related U.S. Application Data

(63) Continuation-in-part of application No. 11/733,151, filed on Apr. 9, 2007, now Pat. No. 7,872,563.

(51) Int. Cl.
*H01C 7/10* (2006.01)

(52) U.S. Cl. ..... 338/20; 338/22 R; 424/489; 264/259; 264/658; 428/304.4

(58) Field of Classification Search ..... 338/20, 338/22 R; 424/489, 400, 490; 264/43, 259, 264/625, 628; 428/304.4
See application file for complete search history.

(56) References Cited

U.S. PATENT DOCUMENTS

| | | | | |
|---|---|---|---|---|
| 6,409,907 | B1 * | 6/2002 | Braun et al. | 205/317 |
| 6,669,961 | B2 * | 12/2003 | Kim et al. | 424/489 |
| 6,957,511 | B1 * | 10/2005 | Leigh et al. | 451/36 |
| 2006/0140843 | A1 * | 6/2006 | Sung et al. | 423/351 |
| 2008/0246580 | A1 * | 10/2008 | Braun et al. | 338/20 |

FOREIGN PATENT DOCUMENTS

WO WO2004053205 * 6/2004

OTHER PUBLICATIONS

An, S.J.; Hong, Y.J.; Yi, G-C.; Kim, Y-J.; Lee, D.K. "Heteroepitaxial Growth of High-Quality GaN Thin Films on Si Substrates Coated with Self-Assembled Sub-micrometer-sized Silica Balls," *Advanced Materials*, 2006, 18, pp. 2833-2836.

* cited by examiner

*Primary Examiner* — Kyung Lee
(74) *Attorney, Agent, or Firm* — Brinks Hofer Gilson & Lione

(57) ABSTRACT

A porous device for optical and electronic applications comprises a single crystal substrate and a porous single crystal structure epitaxially disposed on the substrate, where the porous single crystal structure includes a three-dimensional arrangement of pores. The three-dimensional arrangement may also be a periodic arrangement. A method of fabricating such a device includes forming a scaffold comprising interconnected elements on a single crystal substrate, where the interconnected elements are separated by voids. A first material is grown epitaxially on the substrate and into the voids. The scaffold is then removed to obtain a porous single crystal structure epitaxially disposed on the substrate, where the single crystal structure comprises the first material and includes pores defined by the interconnected elements of the scaffold.

22 Claims, 10 Drawing Sheets

POROUS DEVICE FOR OPTICAL AND ELECTRONIC APPLICATIONS AND METHOD OF FABRICATING THE POROUS DEVICE

RELATED APPLICATION

The present patent document is a continuation-in-part of U.S. patent application Ser. No. 11/733,151, which was filed on Apr. 9, 2007 now U.S. Pat. No. 7,872,563, and is hereby incorporated by reference in its entirety.

FEDERALLY SPONSORED RESEARCH OR DEVELOPMENT

This material is based upon work supported in part by the U.S. Army Research Laboratory and the U.S. Army Research Office under contract/grant number DAAD19-03-1-0227. The U.S. government may have rights in this invention.

TECHNICAL FIELD

This disclosure is related generally to devices for optical and electronic applications and more particularly to porous single crystal structures with photonic and electronic functionality.

BACKGROUND

Since their conception over 20 years ago, three-dimensional (3D) photonic crystals have been touted for their extraordinary potential in the area of optoelectronics. However, these ideas have yet to come to fruition and the optoelectronics research space has been dominated by work on two-dimensional photonic crystals. The fundamental limiting factor for moving into 3D devices is the difficulty of fabricating 3D photonic crystals with complete or nearly complete photonic band gaps and the required electronic properties (e.g., high mobility and low defect density). A photonic band gap is analogous to an electronic band gap in that photons of a particular range of energies (frequencies) are forbidden to propagate within the crystal. This may be accomplished by modulating the dielectric constant in three dimensions in a periodic fashion. Most fabrication techniques, in particular those which are rapid, flexible in terms of structure, and commercially relevant, result in amorphous or polycrystalline materials with poor electronic properties. Those which can create single-crystal structures, such as wafer bonding and layer-by-layer assembly, are hindered by slow fabrication times and limitations on the possible photonic crystal structures. In addition, electrically driven emission has not been demonstrated for single-crystal structures resulting from fabrication techniques. Owing to this limitation, to date, 3D photonic crystals have primarily been explored for use as passive devices, such as a frequency selective reflector for a wide frequency range, since photons of the energy within the gap may be reflected from the structure.

The application space for photonic materials may be opened up if an approach for fabricating structures having electronic functionality as well as the required complex 3D structure on the proper length scales can be developed. The emergence of such 3D structures may also prove advantageous for current and future electronic devices, as well as other applications.

BRIEF SUMMARY

The inventors have developed a method of creating porous 3D single-crystal structures with photonic and electronic functionality. These structures have substantial control over light that interacts with them while maintaining advantageous electrical properties (e.g., conductivity and carrier mobility). This unique combination of electrical properties and optical control in a single three-dimensional material structure may allow greatly improved efficiency of existing optical and electronic devices, as well as enabling entirely new devices.

According to one embodiment, a porous device for optical and electronic applications comprises a single crystal substrate and a porous single crystal structure epitaxially disposed on the substrate, where the porous single crystal structure includes a three-dimensional arrangement of pores.

According to another embodiment, the device comprises a single crystal substrate and a porous single crystal structure epitaxially disposed on the substrate, where the porous single crystal structure includes a periodic arrangement of pores.

A method of fabricating such a porous device includes forming a scaffold comprising interconnected elements on a single crystal substrate, where the interconnected elements are separated by voids. A first material is grown epitaxially on the substrate and into the voids. The scaffold is then removed to obtain a porous single crystal structure epitaxially disposed on the substrate, where the porous single crystal structure comprises the first material and includes pores defined by the interconnected elements of the scaffold.

DETAILED DESCRIPTION

Described herein is a new approach for fabricating single crystal, three-dimensional (3D) porous structures for photonic and optoelectronic applications based on the selective area epitaxy of materials such as III-V semiconductors. The approach allows epitaxial growth of the single crystal structures through three-dimensional scaffolds or templates to produce high-quality optical and electronic devices.

The fabrication method involves forming a three-dimensional scaffold on a single crystal substrate. The scaffold typically has characteristic dimensions ranging from tens of nanometers to a few microns. The terms template and scaffold are used interchangeably throughout this disclosure in reference to the framework of interconnected elements employed to direct growth of the 3D single crystal structure on the substrate. The scaffold, which is typically formed of an insulating material, is constructed on the single crystal substrate by colloidal assembly, lithography, or another suitable technique. The substrate is typically made of a III-V semiconductor such as GaAs, InP or GaN, although other materials, such as sapphire, may also be suitable.

Once the scaffold is formed, a single crystal material is grown epitaxially on the substrate and into the voids of the scaffold. The material may be a semiconducting material, such as a group IV semiconductor, a III-V semiconductor, or a II-VI semiconductor. After growth of the single crystal material, the scaffold is removed to yield a single crystal structure epitaxially disposed on the substrate with an arrangement of pores as defined by the scaffold. The porous single crystal structure may be grown to a thickness ranging from a few nanometers to several hundred microns, depending on the intended application. Generally, the porous single crystal structure includes from two to 100 layers of pores. Heterostructures may be formed during growth as well (for example, GaAs/InGaAs/GaAs), as discussed further below.

As used herein, "epitaxial" is used in reference to a single crystal structure having crystallographic characteristics, such as crystal lattice structure and orientation, that are influenced by those of the underlying single crystal substrate during growth. There is generally a large degree of lattice matching at the interface between an epitaxial structure and the underlying substrate, and such a structure may be said to be "epitaxially disposed" on the substrate. A single crystal structure that is described herein as growing epitaxially on a substrate is understood to be formed with crystallographic characteristics influenced by or mirroring those of the underlying substrate.

Figure 1:
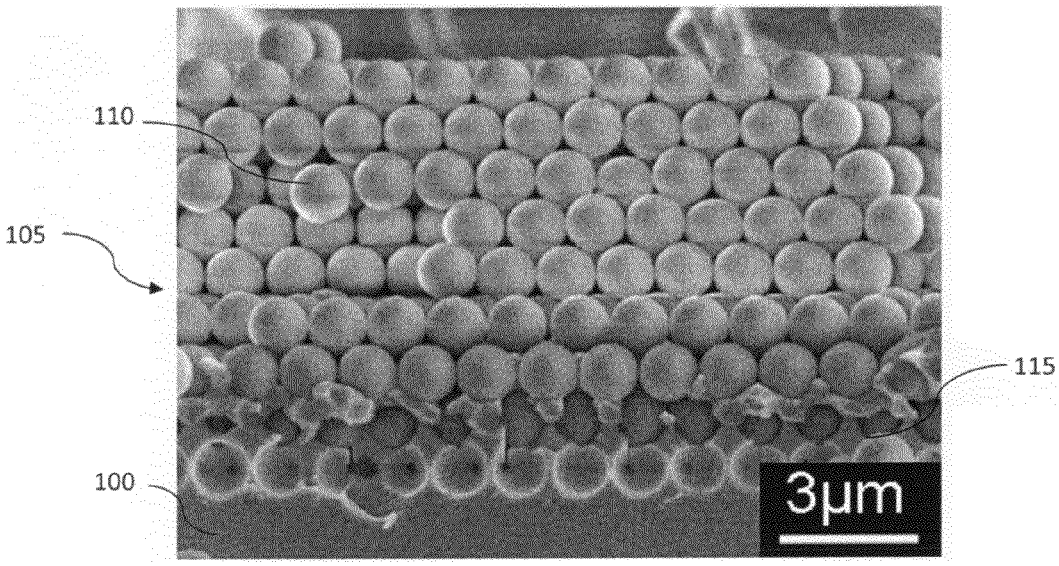
FIG. 1 is a scanning electron microscopy (SEM) image showing epitaxial growth of a GaAs single crystal structure from the surface of a GaAs substrate through an exemplary three-dimensional (3D) template (scaffold)
Figure 2:
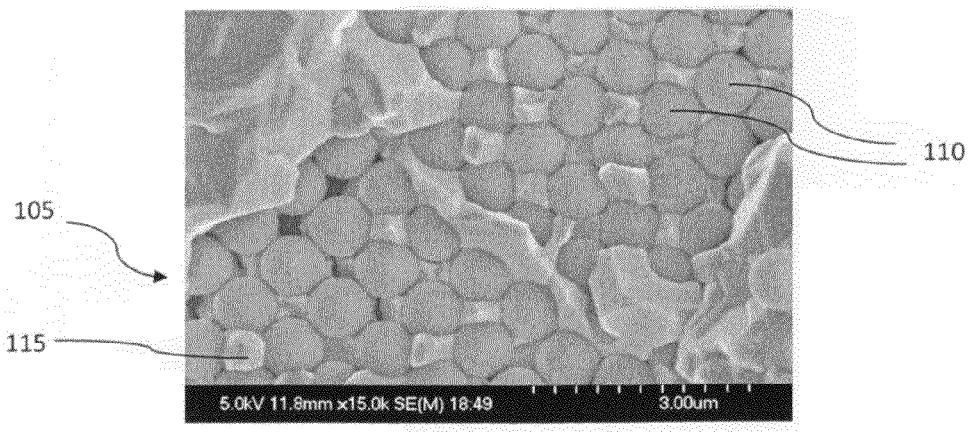
FIG. 2 is an SEM image showing the growth of the single crystal structure of FIG. 1 beyond the surface of the 3D template.

FIG. 1 is a scanning electron microscopy (SEM) image showing epitaxial growth from the surface of a substrate 100 through an exemplary three-dimensional scaffold or template 105 made up of spherical particles (the "interconnected elements" 110 of the template 105). Analysis of the image makes clear that the void space between each particle 110 is full, which indicates that growth occurs from the substrate 100 up through the template 105 and that conformal growth on the template 105 is avoided. It is important that growth proceeds from the substrate 100 and not from the template 105 to ensure that an epitaxial single crystal structure 115 is obtained. The SEM image of FIG. 2 shows the growth of the single-crystal structure 115 reaching the surface of the template 105 and continuing above the template 105. The crystal facets are all of the same orientation, which indicates that the material 115 growing through the template is in fact a single crystal. This is confirmed by x-ray diffraction analysis, which is discussed below.

Figure 3A:
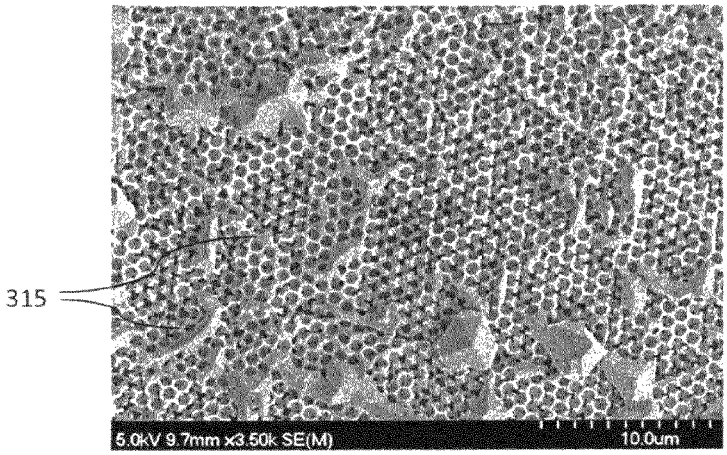
FIGS. 3A-3C are SEM images showing views of the porous single crystal structure obtained upon removal of a template identical to that shown in FIGS. 1 and 2.
Figure 3B:
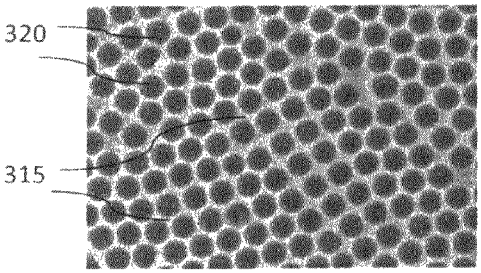
Figure 3C:
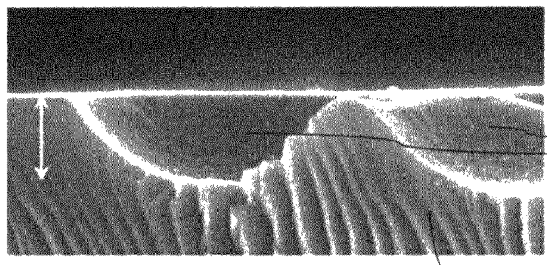

FIGS. 3A-3C are SEM images showing views of the porous single crystal structure 315 obtained upon removal of a template identical to that shown in FIGS. 1 and 2. The resulting structure includes pores 320 defined by the interconnected elements (spherical particles) of the template. The periodicity of the porous structure 315 imparts sophisticated control over light that can either be emitted or collected by the structure 315. In addition, the single crystal nature of the structure 315 imparts advantageous electrical properties to facilitate its use as an active optoelectronic device, such as a quantum well laser or LED. Because heterostructures can be created, active emitters requiring confinement of both electrons and photons, for example lasers, can be directly formed. Other possible applications for these structures include advanced solar cells, thermoelectrics, and materials with controlled thermal conductivities.

Template-Directed Growth

An exemplary template-directed growth process for a single crystal structure (GaAs in this example) on a single crystal substrate (also GaAs) is described here.

First, a scaffold or template is formed on the substrate using a suitable method, such as one of the approaches discussed below or in U.S. patent application Ser. No. 11/733,151 (Braun et al.), which is hereby incorporated by reference in its entirety. The template, which is designed to direct growth of the single crystal structure, includes interconnected elements separated by voids. In this example, the interconnected elements are spherical particles in a three-dimensional periodic arrangement. Other arrangements of the interconnected elements are also possible, such as a two-dimensional periodic arrangement or a three-dimensional aperiodic arrangement.

Prior to growing the single crystal structure, the template is cleaned of organic residue by soaking in acetone for five minutes, repeating, and then soaking in methanol for two minutes followed by two minutes in isopropanol. The template then undergoes an oxygen plasma descum process that entails ten minutes of oxygen plasma at 200 W on an 18" electrode. The native oxide is etched from the template using a 50:50 water:hydrochloric acid solution before the template is placed in the chamber. For example, the template may be dipped in water for ten seconds for "prewetting," etched in the acid solution for 20 seconds, then rinsed in water and placed in isopropanol. The template is blown dry and immediately loaded into a metalorganic chemical vapor deposition (MOCVD) chamber to minimize the time in contact with air after removal from the isopropanol. The chamber may then be evacuated and purged with hydrogen for a suitable time duration, such as 10 minutes.

The MOCVD chamber is a vertical cold-wall reactor operating at atmospheric pressure. The chamber includes a quartz pedestal holding a two-inch diameter graphite susceptor. The outer wall of the chamber is glass, and the gas flow is in from the top through a baffle and out the bottom of the chamber. The process begins with a temperature ramp up to 800° C. for an oxide bakeout in arsine, and then the temperature is adjusted to the growth temperature. For GaAs, the growth temperature generally ranges from about 580° C. to about 900° C., and growth occurs in an excess of arsine (typically a flow rate of 200 sccm of 10% arsine in $H_2$) and a background of hydrogen (10,000 sccm flow rate). Generally, two or more semiconductor precursors are added to the chamber while the substrate is at an elevated temperature to achieve epitaxial growth of the single crystal structure on the substrate. Arsine is typically added to the chamber at a flow rate of about 10 times to about 1,000 times that of the second semiconductor precursor. Precursor gases that may be used for growth (besides arsine) include trimethyl gallium (TMG), trimethyl indium (TMI), disilane (for n-type doping with silicon), diethyl zinc (for p-type doping with zinc), tertiary butylarsine, trimethyl antimony, trimethyl aluminum, triethyl boron, tetraethyl silane, bis-cyclopentadienyl magnesium, diethyl tellurium, tetraethyl tin, ammonia, and phosphine. In the case of InGaAs, the growth temperature generally ranges from about 580° C. to about 625° C. In general, the substrate is heated to a temperature of from about 400° C. to about 1,000° C. for growth of the single crystal structure.

Under proper growth conditions, the natural growth mechanism is by epitaxy. If surface nucleation is suppressed, then, as the precursor gases diffuse through the template and reach the substrate, growth will begin from the substrate upward, as desired. The material grows epitaxially on the substrate and into the voids. There are certain preferential growth directions (corresponding to crystallographic directions) in these materials such that, when the growth front travels upward and reaches the template, it cannot grow further in that direction. Growth occurs around the template by way of the next fastest crystallographic growth direction.

While an MOCVD method is detailed here for carrying out the template-directed epitaxial growth process, other vapor-phase or liquid-phase growth techniques that allow precursors to permeate or infiltrate the voids of the template may also be employed. For example, chemical vapor deposition (CVD), electrodeposition, or liquid phase epitaxy may be suitable for growing the epitaxial single crystal structure.

Figure 4A:
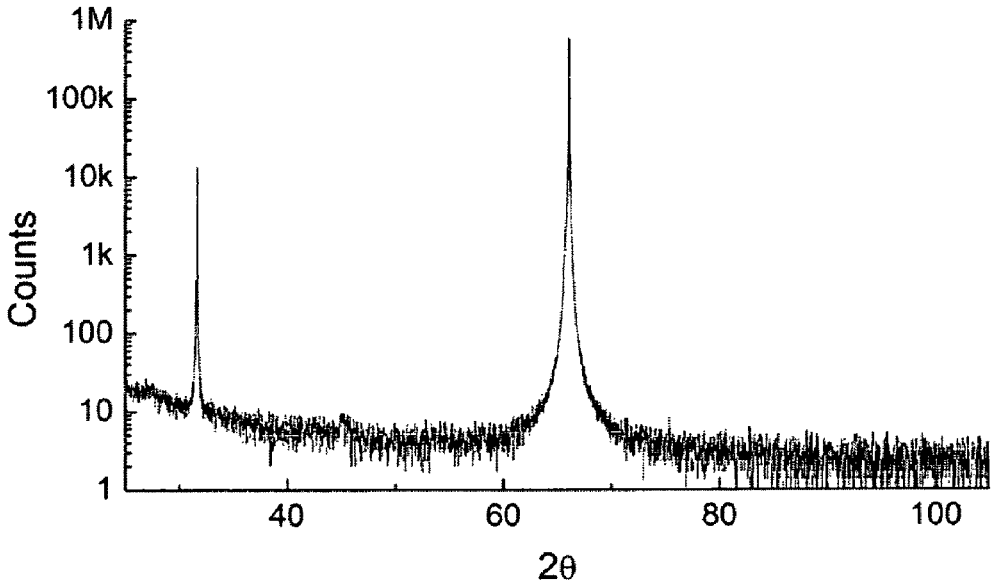
FIGS. 4A-4B and 5A-5B present x-ray and electron diffraction data, respectively, from a GaAs porous single crystal structure obtained by template-directed growth.
Figure 4B:
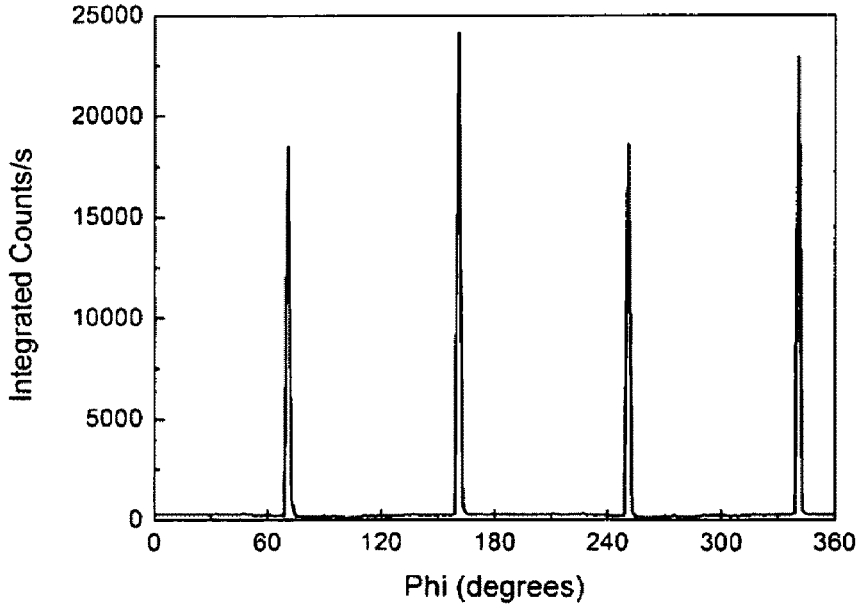
Figure 5A:
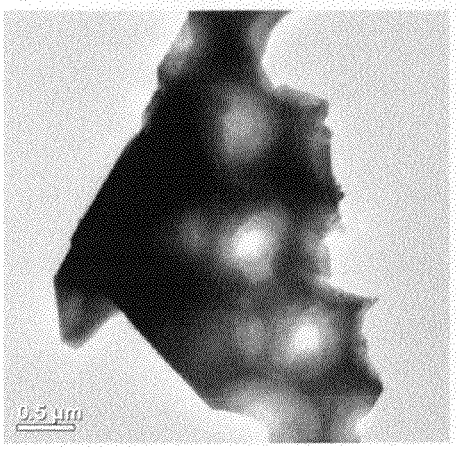
Figure 5B:
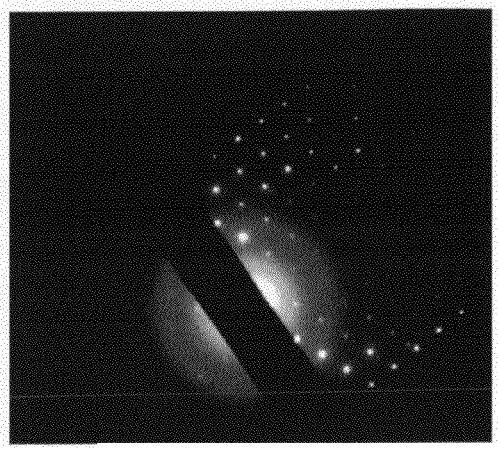

FIGS. 4A-4B show x-ray diffraction data and 5A-5B show electron microscopy and diffraction data of GaAs obtained by the template-directed growth process to demonstrate that the growth from the surface is in fact epitaxy as opposed to polycrystalline nucleation. The x-ray diffraction pattern of FIG. 4A is a 2theta/omega measurement of a GaAs 3D structure on a GaAs substrate. The only observed peaks are 004 and 002 reflections, indicating there is shared orientation with the substrate of the atoms parallel to the surface. Texture measurement of (111) reflections of GaAs (004) are shown in FIG. 4B. The only observed peaks are those of the four (111) reflections, spaced by 90 degrees. This combined with the previous figure is indicative of an epitaxial relationship between the film and the substrate. Since the substrate and film would share orientation if epitaxially disposed, the peaks should overlap and be indistinguishable. Thus, the film is either epitaxial or amorphous, yielding diffracted intensity. The electron diffraction pattern of FIG. 5B shows a hexagonal diffraction pattern, which indicates that the MOCVD grown structure is crystalline, not amorphous, and therefore the data of FIGS. 4A-B strongly suggest that the film is epitaxial with the substrate. The inventors observe some twinning in the colloidal crystal templates; however, they speculate that this may be due to the curvature of the template, and that a more polyhedral or even cube-like template could prevent this entirely. Although twinning is a crystallographic defect, it does not destroy the perfection of the film in the same way as does a grain boundary with unoccupied bonds.

Figure 6A:
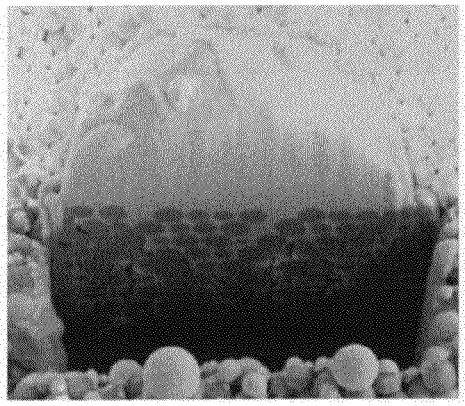
FIGS. 6A and 6B are SEM images showing how surface nuclei may penetrate into and cover the 3D template under non-ideal growth conditions.
Figure 6B:
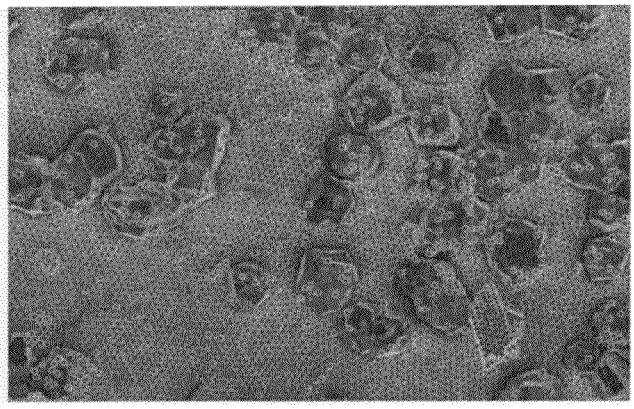
Figure 7:
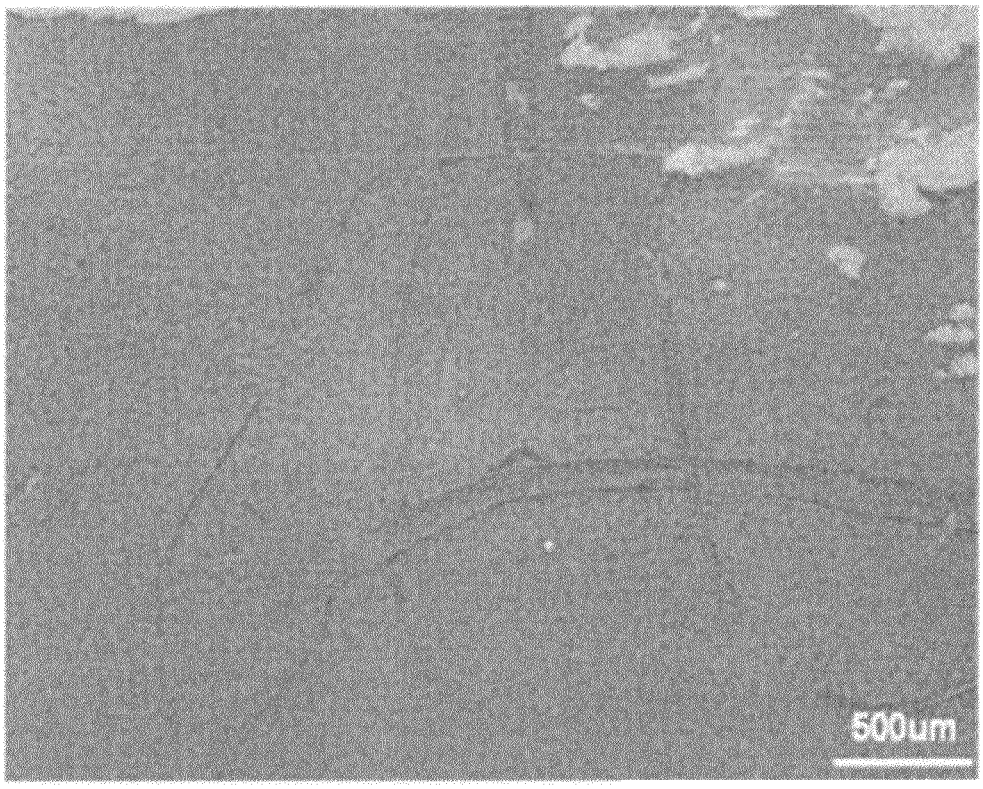
FIG. 7 is an SEM image showing how surface nucleation may be suppressed under proper growth conditions.

Surface nucleation is suppressed by reducing the flow rate of TMG or TMI below a threshold value. This value is typically about an order of magnitude lower than typical flow rates for 2D patterned substrates. The SEM images of FIGS. 6A and 6B show how, under non-ideal growth conditions, surface nuclei can cover the top surface of the template and penetrate into the template like an iceberg. The SEM image of FIG. 7 shows how, under proper growth conditions, as discussed below, surface nucleation is suppressed. Only two nuclei are shown in the figure (near center). The area in the upper right area of the micrograph show contamination and scratches, not surface nucleation.

After growth, the template is removed to obtain a porous, single crystal GaAs structure epitaxially disposed on the substrate. The structure includes pores defined by the interconnected elements of the template (scaffold), and thus the pores are interconnected. To facilitate template removal, the interconnected elements of the template are preferably accessible via the top of the as-grown structure. Template removal may be achieved by wet or dry etching or another technique. For example, the sample may be immersed in a 50:45:5 solution of water:ethanol:HF or another suitable etchant for approximately 20-30 minutes (depending on the etchant, template thickness, and dimensions of the interconnects between the template elements). The 3D structure is then removed from the HF solution and immersed in water and agitated, then rinsed with ethanol and placed on a hot plate to dry at 40° C. Typically, each pore has a linear dimension (e.g., a diameter in the case of spherical pores) in the range of from about 10 nm to about 50 microns. The porous single crystal structure may contain from one to 100 layers of pores, and may have a thickness ranging from a few nanometers to a few hundred microns.

Figure 8A:
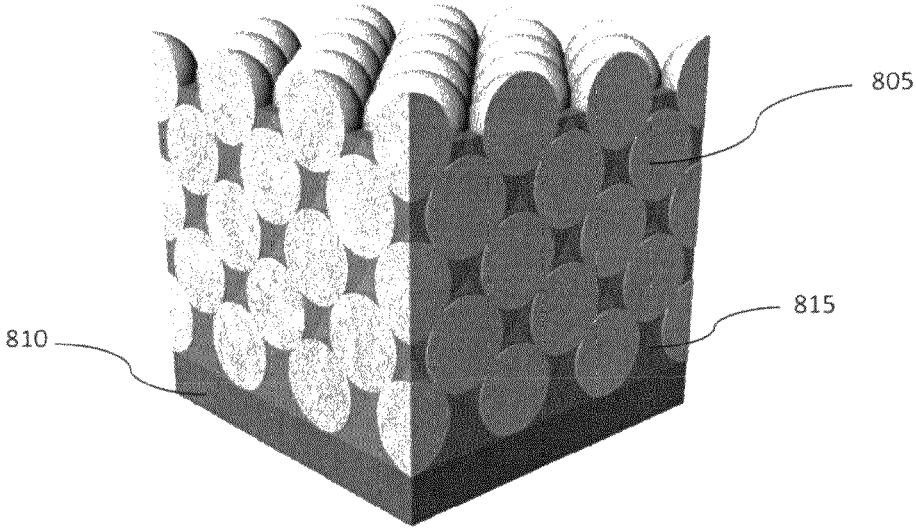
FIGS. 8A-8B is a schematic of epitaxial growth on the exposed surfaces of a single crystal template.
Figure 8B:
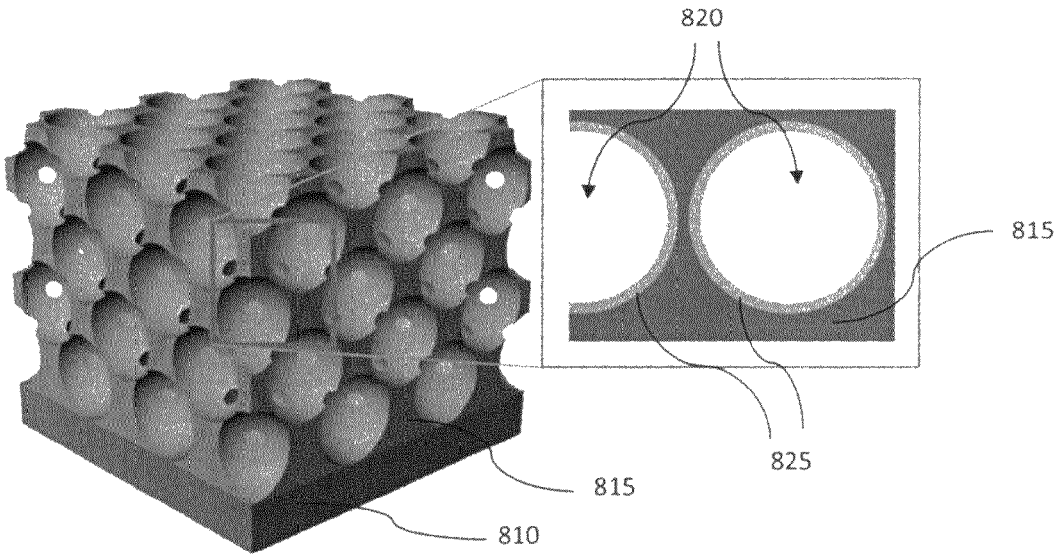

Surface recombination is a significant issue in light emitting devices because injected carriers may be trapped at dangling bonds (surface states), resulting in non-radiative recombination and thus low device efficiency. To prevent recombination at surface states, the inverted structure (the porous single crystal structure obtained when the template is removed) may be capped with a wider band gap material, such as AlGaAs when GaAs is grown, to prevent recombination at surface states. Capping with AlGaAs passivates the GaAs surface, and since AlGaAs has a larger bandgap than GaAs (and InGaAs in the case of heterostructures), the injected carriers stay in the GaAs. Evidence of AlGaAs surface passivation is based on SEM characterization of capped structures and photoluminescence (PL) measurements, which are discussed further below. In addition, epitaxial growth of a second material on the surface of a first material of the 3D structure (after removal of the template) could be used to create additional junctions of similar or dissimilar materials with potential applications in electronics. Growth of additional material on the porous, single crystal structure is shown schematically in FIGS. 8A-8B. Initially a template 805 is grown on a single crystal substrate 810 and infiltrated by epitaxial growth of a first material 815 (FIG. 8A). The template 805 is then removed, exposing the pores 820 of the single crystal structure 815, and placed back in the reactor for subsequent growth of another material or materials. Since the structure 815 is entirely single crystalline, all surfaces are available for growth of the subsequent material(s) 825, yielding a substantially continuous and conformal epitaxial layer on the structure 815, as illustrated in FIG. 8B (inset). The growth may be termed pseudo-conformal because the growth thickness of the subsequent material 825 on the single crystal structure 815 is may not be identical on all surfaces. Instead, the growth may occur faster in certain crystal directions resulting in faceting, as described below.

Figure 9A:
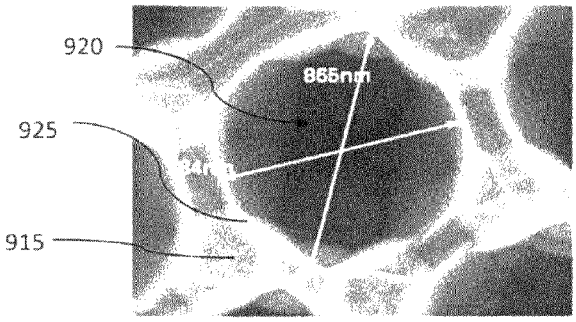
FIGS. 9A and 9B are SEM images of a GaAs porous single crystal structure capped with AlGaAs.
Figure 9B:
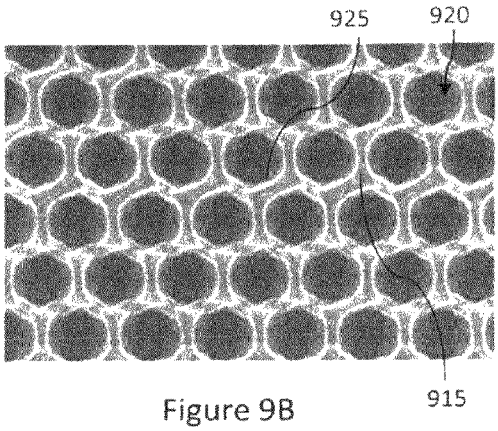
Figure 10:
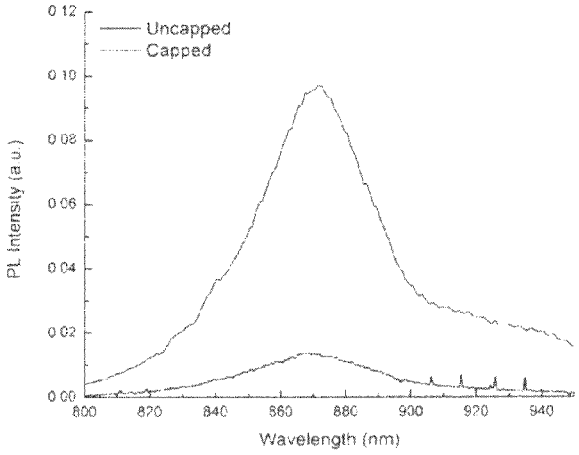
FIG. 10 shows photoluminescence intensity data from a capped GaAs structure.

In this example, the cleaned GaAs porous structure is reloaded into the reactor for capping. The sample may be capped with AlGaAs at the same flow rates as employed for GaAs growth. Surface nucleation is not an issue in this case because the template has been removed, and all remaining material is available for epitaxial growth. FIGS. 9A and 9B show a porous single crystal GaAs structure 915 that has been capped with an AlGaAs layer 925. AlGaAs growth occurs fastest on preferential growth facets of the pores 920 remaining after inversion, resulting in a polyhedral shaped pore, rather than a spherical pore, which can be seen in FIGS. 9A and 9B. In addition, each pore 920 shows an identical polyhedral pattern, indicating both epitaxy during the initial growth and on the exposed GaAs surfaces during AlGaAs growth. More quantitative analysis using photoluminescence (PL) measurements shows the GaAs band edge PL intensity of a capped photonic crystal structure is almost an order of magnitude greater than that of the structure before being capped, as shown in FIG. 10. This improvement is as expected for a passivated surface, though further improvement is possible. The capping step may be advantageous or essential for the fabrication of many commercially important devices requiring surface passivation to reduce non-radiative recombination.

Figures 11A, 11B:
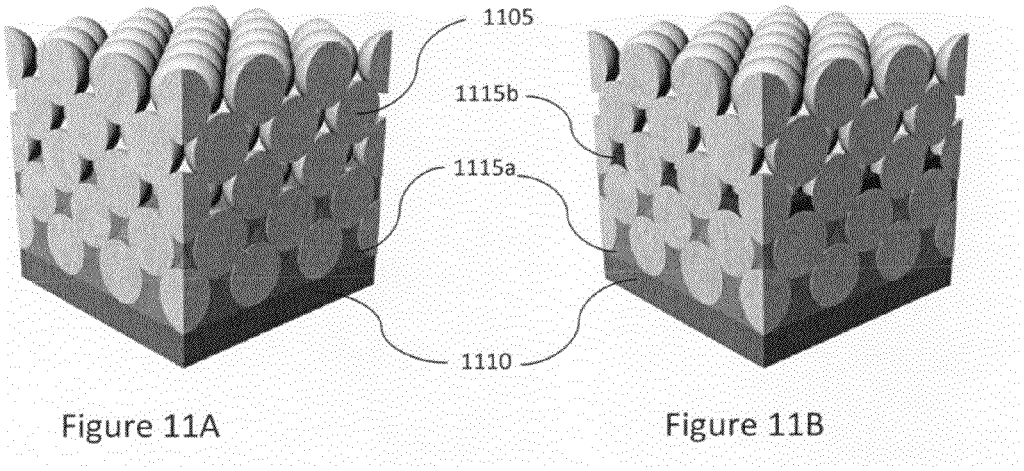
FIGS. 11A-11D is a schematic of growth of multiple materials through a 3D template to form embedded heterostructures.
Figures 11C, 11D:
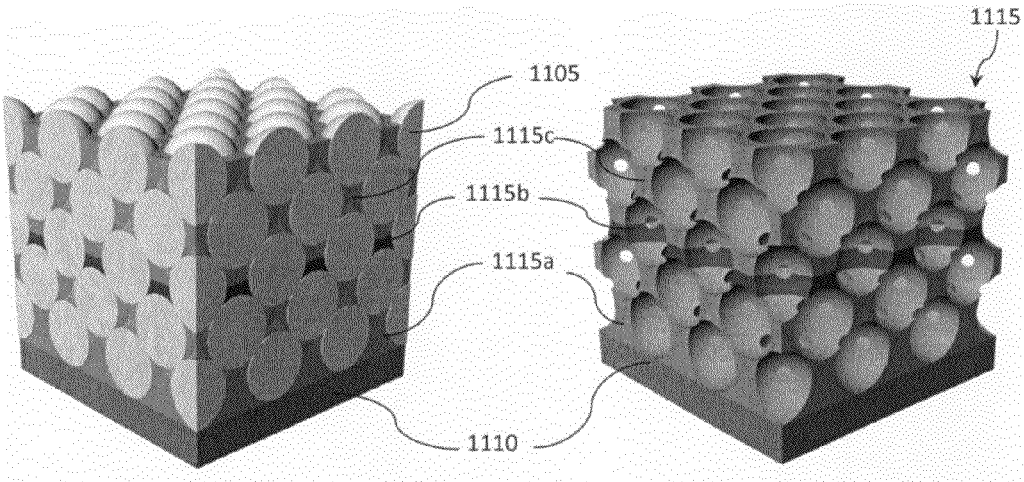

If the template is not removed prior to growth of the one or more subsequent materials on the first material of the single crystal structure, then the subsequent material may define a porous epitaxial layer on the first material, instead of a substantially continuous and conformal layer. Such a structure is described further below in reference to FIGS. 11A-11D, which show steps of a method to produce an electronic heterostructure for light emitting devices. Typically this herostructure is a quantum well, which includes a thin layer (usually less than about 10 nm depending on the materials) of a narrower band gap material surrounded by higher band gap material(s) on either side. Carriers injected from p-type doped and n-type doped materials on the top and bottom get trapped in the potential well provided by the low band gap material where they recombine, emitting light. Starting with a GaAs matrix, InGaAs is an attractive material to use as the quantum well layer. Referring to FIGS. 11A-11D, growth is initiated using a first material 1115*a* and the precursor gases are changed during growth to form a second material 1115*b* (as shown in FIG. 11B). The second material is then covered by one or more additional materials 1115*c* that may be the same or different from the first material 1115*a*. Following completion of the growth, the template is removed yielding the final, porous single crystal structure 1115 including first, second, and third materials 1115*a*, 1115*b*, 1115*c*. This structure may then be placed back in the reactor and conformally capped with a higher band gap material, as described previously.

Both quantum well and quantum dot LEDs and lasers are applicable devices with InGaAs/GaAs heterostructures, as are devices operating in reverse, such as sensors or photovoltaics. AlGaAs may not be as practical as a heterostructure material without significant refinement or greatly reduced flow rates due to the propensity for the aluminum-containing precursor to stick to the template, leading to significant surface nucleation. Other potentially useful semiconductors that may be grown by the above-described template-directed growth process include phosphorous-containing materials, such as InGaP, and III-nitrides, such as GaN, which the inventors believe may be successfully grown using a $SiO_2$ template. The process is also believed to be suitable for forming porous single crystal structures from ferroelectrics and other non-semiconducting materials. Devices such as LEDs based on GaN have certain inefficiencies that the present method would be likely to improve upon.

Generally speaking, the template-directed growth process is applicable to any material that may be grown epitaxially on a substrate and through the template to form a three-dimensionally interconnected (monolithic) single crystal structure. For example, materials including one or more of the following elements may be grown: Al, Si, Ti, V, Cr, Mn, Fe, Co, Ni, Cu, Zn, Ga, Ge, As, Se, Zr, Nb, Mo, Ru, Rh, Pd, Ag, Cd, In, Sn, Sb, Te, Hf, Ta, W, Re, Os, Ir, Pt, Au, TI, Pb, and Bi. Preferably, the material is an elemental or a compound semiconductor, such as a Group IV semiconductor, a III-V semiconductor, or a II-VI semiconductor. Suitable semiconductors may include, for example, both electrically doped or undoped: Si, Ge, SiC, SiGe, GaAs, GaN, GaP, AlGaAs, AlGaN, AlGaP, InGaAs, InGaN, InGaP, InSb, InAs, InP, CdSe, CdS, CdTe, ZnO, ZnSe, and ZnTe. Furthermore, as described above, the single crystal structure may include more than one material. The substrate may comprise the same or a different material as the single crystal structure.

Template Characteristics and Fabrication

The template employed in the growth process is generally formed of an insulator or another material on which the precursors or their related, partially fragmented species (e.g., monomethyl gallium, fragmented from trimethyl gallium) tend not to deposit. For example, $SiO_2$, $Al_2O_3$, tungsten and $Si_3N_4$ may be suitable materials for the template.

The framework of interconnected elements that make up the three-dimensional template may be periodic in one, two or three dimensions. For some applications, it may be preferred that the template is aperiodic in all dimensions. The geometry of the template, that is, the morphology and arrangement of the interconnected elements, may vary depending on the fabrication method employed and the desired applications. For photonic crystal applications, the photonic band gap scales linearly with the lattice constant of the template, so the lattice constant (or pore size) may be varied to adjust the photonic band gap to lie in the wavelength range of interest. For typical colloidal crystal templates and a quantum well emitting at around 1.0 micron in wavelength, the pore size may be about 600 nm. Generally speaking, a template feature size in the range of from about 10 nm to about 50 microns is suitable for the fabrication of 3D single crystal structures for photonic or other applications. The single crystal structures may need to be about 8-10 layers thick to see significant photonic crystal effects. Thicker is better from a photonic perspective, up to a thickness of about 14-16 layers, where the single crystal is effectively infinite to the incident or emitted light. However, increased thickness may require reduced flow rates to prevent surface nucleation due to more tortuous diffusion through the porous template. For this reason, the thinnest structure that provides the required photonic effects is most desirable. For applications not based on photonics, the thickness may be dictated by properties such as the absorption cross-section or total volume of material required for a given application, among other criteria.

Since the single crystal structures grown through the template generally have an electronic function in addition to an optical function, the template design can be considered from a perspective beyond that of optical functionality. One consideration is the physical size of the final, 3D single crystal semiconductor structure. If the structure includes thin ligaments or segments on the order of 10-20 nm through which electrons must be transported, the electrons may face a large potential barrier when they try to enter these ligaments due to quantum size effects. In addition, thin ligaments may lead to inhomogeneous carrier concentration as the carriers may tend toward the physically larger regions due to quantum size effects. Both effects may lead to decreased or unstable device performance and must be considered. Preferably, the ligaments of the 3D single crystal structure are at least about 30-40 nm in lateral dimension.

Also, template orientation with respect to the substrate is important. The single crystal materials grown have preferential growth directions. Forcing the single crystal to grow in other directions, particularly along higher energy directions, may lead to crystalline defects, such as dislocations or twinning. To avoid this issue, it is advantageous to align the template with the substrate flats by rotation about the surface normal. Templates formed in a woodpile structure (layers of rods stacked on one another and rotated 90 degrees between layers) or similar geometry may be ideal because they allow for growth almost entirely in the <001> family of directions.

Typically, the template is composed of an oxide, and it may be formed by any of a number of routes. For example, the template may be assembled from monodisperse (uniform) particles of silica or alumina. The particles may be spherical or may have a polyhedral shape, such as a tetrahedral, cubic, octahedral, or dodecahedral shape. The diameter of the particles (or other linear dimension in the case of nonspherical particles) is generally determined by the wavelength range of interest for the device to be formed, since the material of the template, once removed from the substrate, creates the porosity of the epitaxial single-crystal material. For electronic devices that do not require a photonic crystal, the diameter of the particles is chosen to yield the desired surface/volume ratio, feature sizes to minimize carrier diffusion lengths, or another optimized parameter. Particles having a diameter or linear dimension in the range of from about 400 nm to about 1,000 nm may be employed to form the template. Larger particles of up to tens or hundreds of microns, or smaller particles of submicron or nanoscale sizes, may also be used for template formation depending on the intended application of the single crystal structure to be grown. The particles are preferably highly monodisperse to facilitate packing into an ordered, face-centered cubic (fcc) structure.

A vertical evaporation technique may be employed to self-assemble the particles (e.g., spheres). The evaporation technique may entail adding a dilute suspension of the particles in ethanol to a scintillation vial and heating (e.g., at 30-50° C. depending on the particle size) with a substrate placed vertically in the vial. As the solvent evaporates, the particles assemble into a lattice having, for example, an fcc packing arrangement, thus forming a thin film on the substrate. The growth of the template may take place on a semiconductor substrate, such as a GaAs substrate or another III-V substrate.

Figure 12A:
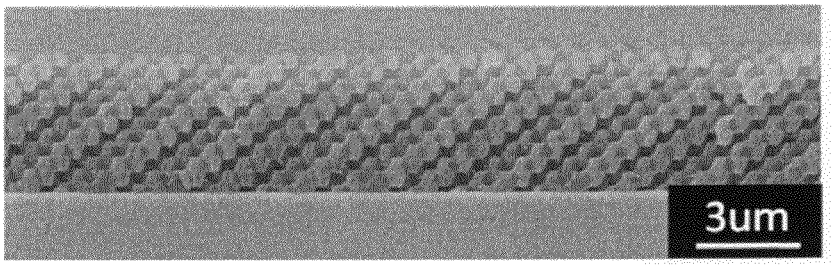
FIGS. 12A-12D are SEM images showing a holographically formed 3D template, its conversion to an alumina template and the resulting GaAs structure formed by epitaxial growth through the alumina template.
Figure 12B:
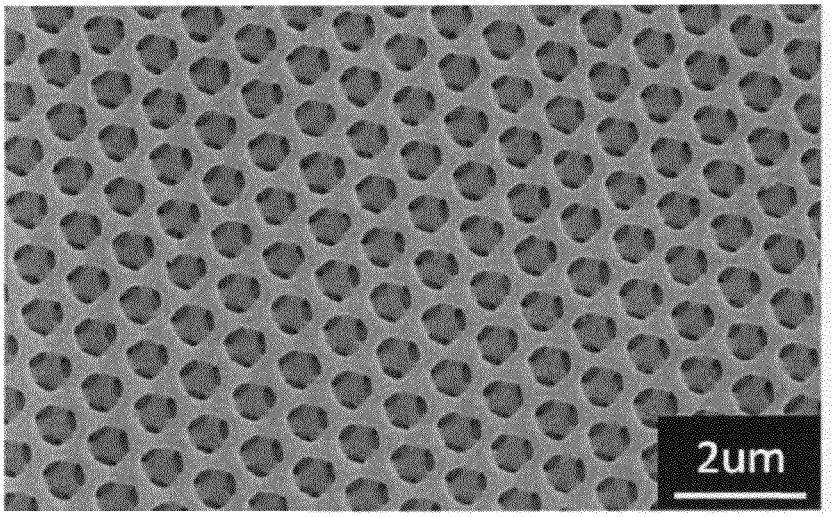
Figure 12C:
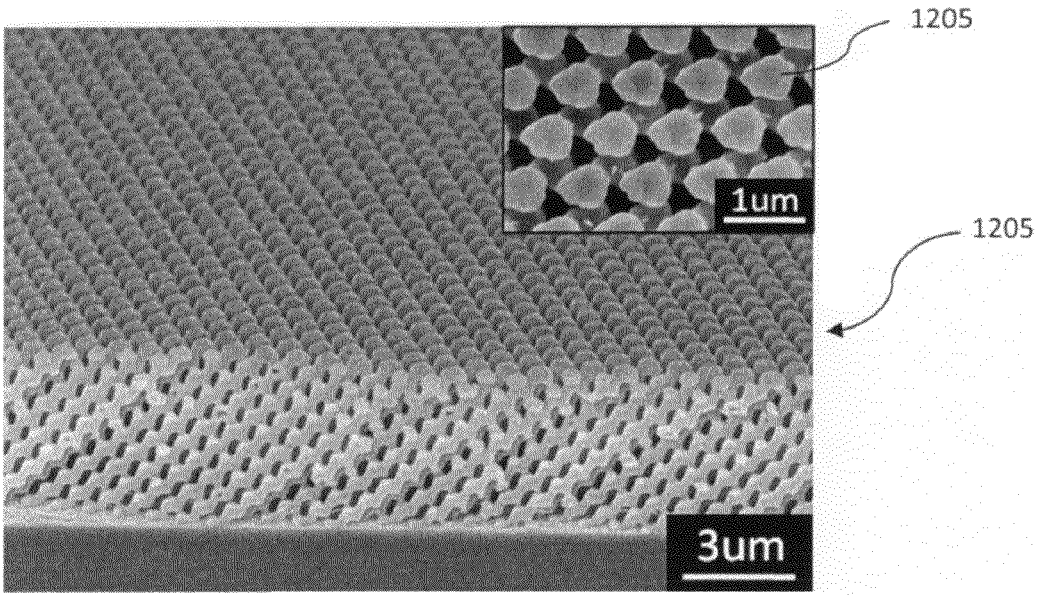
Figure 12D:
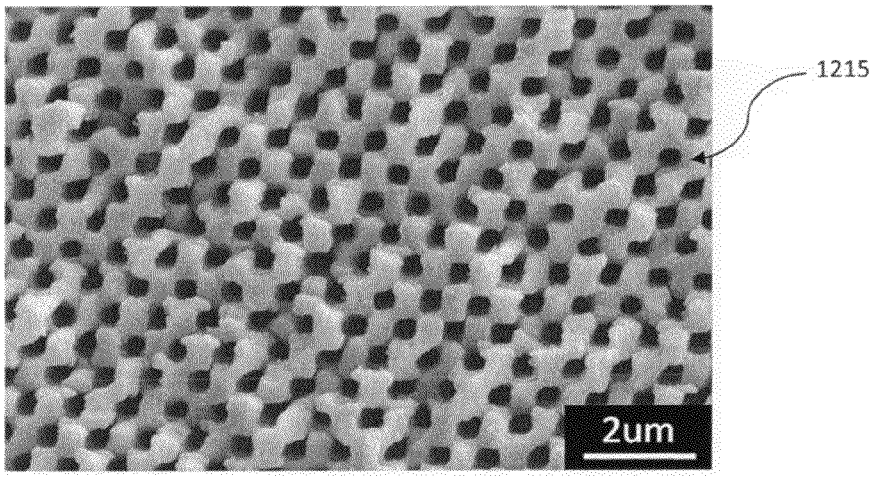

Alternatively, the template may be formed by other techniques, such as interference lithography. In this case, photoresist is spun onto the substrate and several laser beams are interfered under precise conditions to form a 3D interference pattern of desired symmetry. Upon development, a 3D structure of photoresist remains on top of the GaAs (FIG. 12A-12B). This is then infiltrated with a material such as aluminum oxide using atomic layer deposition (ALD) or another suitable technique, and the photoresist is removed, resulting in an aluminum oxide template or a template 1205 on a GaAs wafer (FIG. 12C). The template 1205 may then be used to grow the 3D epitaxial structures 1215 described herein (FIG. 12D).

Templates formed by other routes may also be suitable for fabricating single crystal porous structures, as long as they provide the desired photonic crystal symmetry and are fabricated from a material to which the precursors are unlikely to stick. For applications not related to photonics, such as 3D patterning for integrated circuits, photovoltaics or sensors, the periodicity (if required) does not have to be on the same length scale; in particular, it may be on a much smaller length scale, such as from a few nanometers to about 300 nm, and the template formation may be very different. For optoelectronics using photonic crystals, however, the desired periodicity is typically on the length scale mentioned above.

Optimization of MOCVD Growth Conditions

To determine the threshold precursor flow rate below which nucleation can be suppressed during the template-directed growth process, experiments and finite element modeling following Sugiyama et al. (M. Sugiyama, H.-j. Oh, Y. Nakano, Y. Shimogaki, *Journal of Crystal Growth* 261, 411 (2004)) are performed. The threshold concentration of a semiconductor precursor can be determined and converted to a maximum partial pressure over the template above which nucleation will occur. The flow rates of the precursors may be correspondingly adjusted to ensure that the partial pressure over the template does not exceed this value.

The experiments entail patterning a bare III-V substrate with a 2 mm×7 mm $SiO_2$ strip (mask) of 200 nm in thickness. The patterned substrate is placed in the reactor and 200 nm of III-V material is grown. To a first approximation, the precursors are consumed only at the exposed substrate surface where growth occurs, leading to depletion of precursor in this region and diffusion of precursor from over the mask toward the exposed semiconductor surface. This results in a concentration profile of the precursor over the mask that peaks at the center of the mask and decreases in a somewhat parabolic manner toward the edge of the mask. Nucleation occurs most heavily in the center of the mask where this concentration profile is peaked. Nucleation ceases at some distance from the mask center. The concentration profile of the precursor over the mask is graphed using finite element modeling and simple Chaman-Enskog binary diffusion equations for the $H_2$/precursor mixture. The distance from the center of the mask at which nucleation ceases can be compared to the finite element modeling data to determine the precursor concentration at that point. This concentration is considered to be the threshold concentration below which nucleation is suppressed. The threshold concentration of the precursor can be converted into a partial pressure and the flow rates may be adjusted to ensure that the partial pressure over the mask does not exceed this value.

It should be noted that due to the consumption of precursor at the semiconductor surface (with both 2D masks and 3D scaffolds (templates)), the inlet concentration and the concentration at the surface are generally not the same. The concentration near the surface is reduced due to growth of the single crystal structure and a finite diffusion time to replenish the precursor consumed during growth. Thus, the inlet concentration can be greater than the threshold concentration as long as the concentration at the surface remains below threshold. One approach to ensuring that the surface concentration does not reach or exceed the threshold concentration, however, is to simply set the inlet concentration below the threshold concentration. A downside of this approach is that the maximum growth rate may not be achieved.

In order to determine the concentration above the 3D template, the structure is modeled using finite element modeling. Diffusion constants are calculated using the Knudsen diffusion equation through a long cylindrical pore with modification for tortuosity through packed spheres, where $D_k$ is the Knudsen diffusion constant, $r_s$ is the radius of the spheres, $\tau$ is the tortuosity factor (estimated to be ~2 from the literature) and $D_e$ is the diffusion contant through the porous template.

$$D_k = \frac{2}{3} r \sqrt{\frac{8RT}{\pi M}}$$

$$r = \frac{2}{3}\left[\frac{\varepsilon}{1-\varepsilon}\right] r_s$$

$$D_e = \frac{\varepsilon D_k}{\tau}$$

Figure 13A:
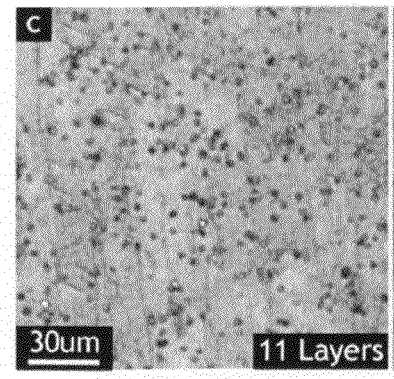
FIGS. 13A-13C are optical micrographs that show the formation of surface nuclei as a function of thickness of the porous single crystal structure.
Figure 13B:
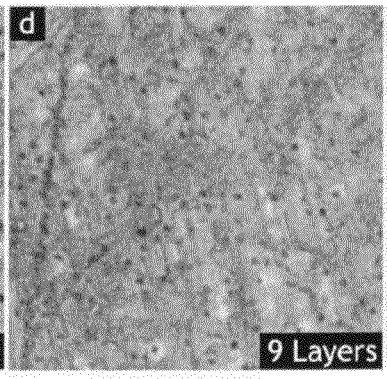
Figure 13C:
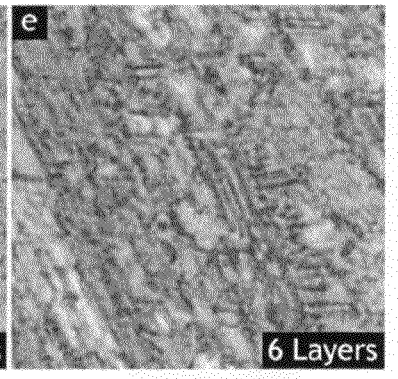

Using this model, it is possible to determine the buildup of precursor above the 3D template caused by slow diffusion through the template, as well as the variation as either the number of layers or the lattice constant is changed and the diffusion time increases. This leads to nucleation on thicker regions for a given flow rate, as shown by the images of FIGS. 13A-13C.

Once the threshold is estimated and a single crystal structure grown, data are generated that may be compared with finite element models of the 3D structure. Using these data, a more accurate sense of the threshold partial pressure for the 3D template may be gained by calculating the concentration above, in this case, 6, 9 and 11 layers. For example, flow rates for the precursors as a function of the pore diameter for GaAs growth in 8 layer samples at 800° C. may be obtained. The flow rate of trimethyl gallium typically ranges from about 0.1 sccm to about 0.5 sccm, and the flow rate of trimethyl indium typically ranges from about 0.8 sccm to about 2 sccm as the indium content is varied.

When growing quantum well structures, suppressing nucleation is somewhat different. Since the quantum well is quite thin (e.g., less than about 12 nm), flow rates that would lead to nucleation if the growth thickness were hundreds or thousands of nanometers may be used while still suppressing nucleation. Because higher flow rates may be used, quantum well structures may be grown at significantly higher growth rates than thicker structures of the same material. This is particularly advantageous with InGaAs, which is grown at lower temperature and utilizes a lower flow rate of precursors to prevent surface nucleation.

Applications

The 3D porous single crystal structures obtained by the template directed growth process have optical and electrical properties not available in polycrystalline systems. Polycrystalline semiconductor materials have poor electrical properties and thus cannot be used as the basis of many optoelectronic or electronic devices, in contrast to the materials described herein. The present method may provide structures having the same degree or better of optical control as compared to current photonic crystal systems, with the added benefit of electronic properties on par with current semiconductor electronics, thus enabling optical devices having very desirable electronic/photonic coupling. The inventors believe the fabrication approach described here may allow 3D photonic crystal research to move from simply photonic structures toward complete optoelectronic devices. Such devices could help solve collection efficiency issues in solar cells, increase energy efficiency in solar cells, and find use in many other areas as efficient, narrow band light emitters or collectors. There is potential in low-threshold lasers, high-brightness LEDs with controlled emission directions, and high-sensitivity sensors. An additional potential application area is employing 3D templating for the fabrication of electronic devices in the third dimension; currently, devices such as computer chips are fabricated as planar devices in a layer-by-layer fashion. In addition, the invention allows fabrication of large-area semiconductor materials with nanoscale feature sizes, allowing for rapid carrier collection over short distances and greatly increased junction area (of a p-n junction in, for example, a solar cell) for a given substrate area, among other important properties.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A porous device for optical and electronic applications, the device comprising:

a single crystal substrate;

and a porous single crystal structure epitaxially disposed on the substrate and comprising a three-dimensional arrangement of pores.

2. The device of claim 1, wherein the three-dimensional arrangement of pores is a periodic arrangement comprising periodicity in at least one dimension.

3. The device of claim 2, wherein the periodic arrangement comprises periodicity in three dimensions.

4. The device of claim 1, wherein the pores are interconnected.

5. The device of claim 1, wherein each pore has a linear dimension in the range of from about 10 nm to about 50 microns.

6. The device of claim 1, wherein the porous single crystal structure has a thickness ranging from a few nanometers to a few hundred microns.

7. The device of claim 1, wherein the porous single crystal structure comprises from two to 100 layers of pores.

8. The device of claim 1, wherein each of the single crystal substrate and the porous single crystal structure comprises a III-V semiconductor.

9. The device of claim 1, wherein the single crystal structure comprises a first material epitaxially disposed on the substrate and a second material epitaxially disposed on the first material, the single crystal structure thereby comprising a heterostructure.

10. The device of claim 9, wherein the second material has a bandgap higher than that of the first material.

11. The device of claim 9, wherein the second material defines a porous epitaxial layer on the first material.

12. The device of claim 9, wherein the second material defines a substantially continuous and conformal epitaxial layer on the first material.

13. The device of claim 9, wherein the single crystal structure further comprises a third material epitaxially disposed on the second material.

14. A method of fabricating a porous device for optical and electronic applications, the method comprising:

forming a scaffold of interconnected elements on a single crystal substrate, the interconnected elements being separated by voids;

growing a first material epitaxially on the substrate and into the voids;

removing the scaffold to obtain a porous single crystal structure epitaxially disposed on the substrate, the porous single crystal structure comprising the first material and including pores defined by the interconnected elements of the scaffold.

15. The method of claim 14, wherein growing the first material epitaxially comprises heating the substrate in a processing unit and adding at least first and second semiconductor precursors for epitaxy to the processing unit.

16. The method of claim 15, wherein the substrate is heated to a temperature of from about 400° C. to about 1,000° C.

17. The method of claim 15, wherein the second semiconductor precursor is added at a flow rate yielding a partial pressure below a nucleation threshold partial pressure in a background flow of the first precursor.

18. The method of claim 15, wherein arsine is the first semiconductor precursor and is added at a flow rate of about 10 times to about 1,000 times that of the second semiconductor precursor.

19. The method of claim 15, further comprising adding a third semiconductor precursor to the processing unit.

20. The method of claim 14, wherein removing the scaffold comprises etching.

21. The method of claim 14, further comprising, after removing the scaffold, growing at least a second material epitaxially on the first material to form a heterostructure.

22. The method of claim 14, further comprising, prior to removing the scaffold, growing at least a second material epitaxially on the first material to form a heterostructure.

* * * * *